United States Patent [19]

Straughn

[11] Patent Number: 4,509,192

[45] Date of Patent: Apr. 2, 1985

[54] SPEAKER ENCLOSURE

[76] Inventor: Roy D. Straughn, 5021 Muldoon Cir., Pensacola, Fla. 32506

[21] Appl. No.: 482,848

[22] Filed: Apr. 7, 1983

[51] Int. Cl.[3] ..... H04R 1/28; G10K 13/00

[52] U.S. Cl. ..... 381/90; 179/146 E; 181/153

[58] Field of Search ..... 381/90; 181/150, 153, 181/156, 199; 179/146 E, 179

[56] References Cited

U.S. PATENT DOCUMENTS

| | | | |
|---|---|---|---|
| 1,741,274 | 12/1929 | Baumann | 181/156 |
| 2,491,982 | 12/1949 | Kincart | 181/156 |
| 2,731,101 | 1/1956 | Klipsch | 381/90 |
| 2,821,260 | 1/1958 | Shaffer | 381/90 |
| 2,915,134 | 12/1959 | Braund | 181/156 |
| 3,638,753 | 2/1972 | Cunningham | 181/153 |
| 3,642,091 | 2/1972 | Nohara | 181/150 |
| 4,057,689 | 11/1977 | Stallings, Jr. | 381/90 |
| 4,123,621 | 10/1978 | Walker | 179/146 E |
| 4,161,230 | 7/1979 | Ripple | 181/150 |
| 4,330,691 | 5/1982 | Gordon | 381/90 |

*Primary Examiner*—Gene Z. Rubinson
*Assistant Examiner*—L. C. Schroeder

[57] ABSTRACT

This speaker enclosure is ideal for public address systems. Primarily, it consists of a ceiling mounted panel, with a conical baffle secured to it, which is used to delay sound off of the back of the speaker, so as not to interfere with the sound from the front of the speaker. It further includes a wire screen, which is used to cut down microphone feedback.

1 Claim, 2 Drawing Figures

SPEAKER ENCLOSURE

This invention relates to audio systems, and more particularly, to a speaker enclosure.

The principal object of this invention is to provide a speaker enclosure, which will be employed particularly for public address systems.

Another object of this invention is to provide a speaker enclosure, which will be adaptable for ceiling mounting.

Another object of this invention is to provide a speaker enclosure, which will be of such structure, as to keep vibration of its components to a minimum, and it will employ a baffle for the delay of sound off of the rear of speaker, so as not to interfere with the sound emitted from the front of the speaker.

A further object of this invention is to provide a speaker enclosure, which will be of such design, as to reduce microphone feedback substantially.

A still further object of this invention is to provide a speaker enclosure, which will insure freedom from back pressure on the speaker cone, thus producing purer audio frequencies.

Other objects are to provide a speaker enclosure, which is simple in design, inexpensive to manufacture, rugged in construction, easy to use, and efficient in operation.

Figure 1:
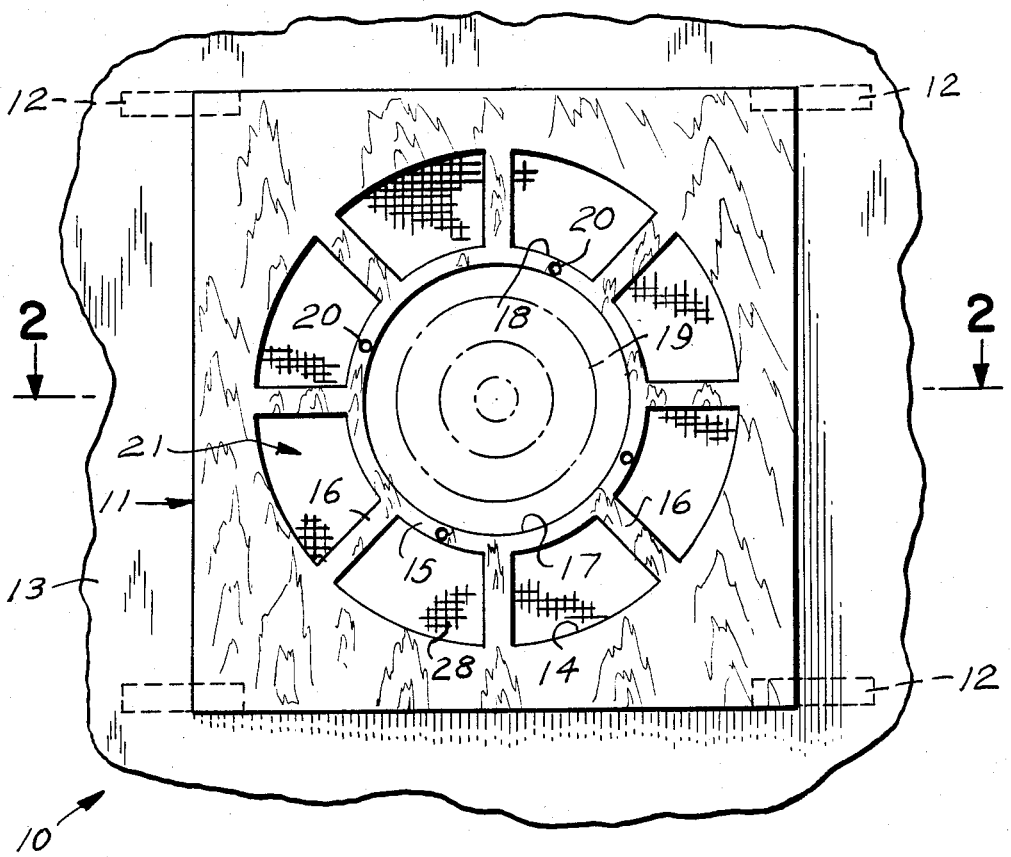
Figure 2:
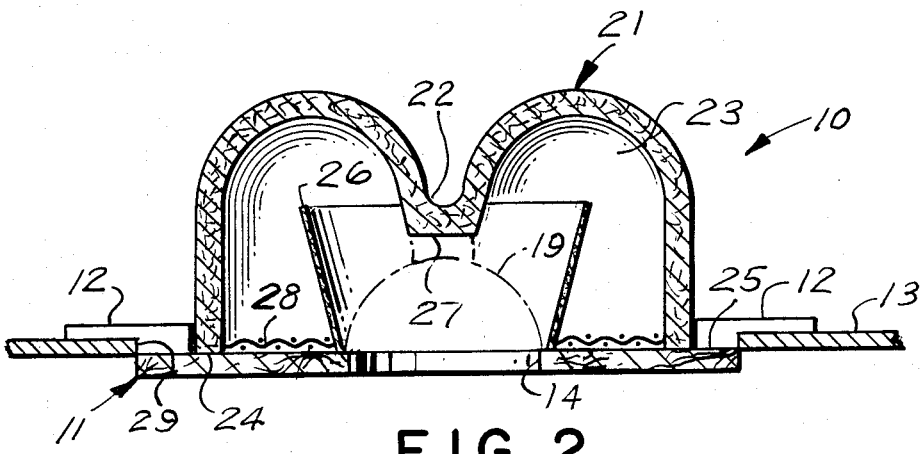

These, and other objects, will be readily evident, upon a study of the following specification, and the accompanying drawing, wherein:

FIG. 1 is a front view of the present invention, shown mounted in a ceiling, which is shown fragmentary, and the speaker structure is illustrated in phantom lines, and FIG. 2 is a cross-sectional view, taken along the line 2—2 of FIG. 1.

Accordingly, an enclosure 10 is shown to include a plywood panel 11, of square configuration, having a mounting bracket 12 of "L"-shaped configuration, secured to the rear of each corner in a suitable manner, not shown. The plurality of brackets 12 are suitably mounted to and above ceiling 13, also in a manner not shown, and it is to be noted, that the illustration in the drawing indicates a suspended ceiling. However, the enclosure 10 is not limited to such mountings. A circular cut-out opening 14, in panel 11, includes a circular center ring 15, which is integrally attached to panel 11 by equally and radially spaced spokes 16, and the above-mentioned arrangement defines a second circular opening 17, and a plurality of radial openings or spaces 18, for the passage of sound during the operation of the speaker 19, which is suitably mounted to ring 15 by a plurality of fasteners, not shown, that are received in the openings 20.

The main body 21 is of circular dome-shaped configuration, with a concave central recess 22 on its outer periphery. The inner periphery of main body 21 forms an annular recessed chamber 23, and the rim 24, of the open end of main body 21, is fixedly secured to the rear surface 25 of panel 11. Main body 21 is fabricated of fiberglass or other suitable material, and is covered with a suitable fireproof coating, to reduce vibration. A fiberglass baffle 26, of frusto-conical configuration, is fixedly secured at its small diameter end to panel 13, in a suitable manner, not shown, and is provided for delaying sound frequencies off the rear of speaker 19, so as not to interfere with the sound from the front of speaker 19. The rear of speaker 19 engages with the flat portion 27 of main body 21, and a galvanized wire screen 28 is bonded to a metalic coating on the inner peripheral surface of main body 21, and is also bonded to the common wire of the amplifier, not shown, so as to cut or reduce microphone feedback.

In use, enclosure 10 is mounted in opening 29 of ceiling 13, by means of the brackets 12, and it is then connected to the output of a public address system amplifier, in the manner known in the art. The screen 28 is also connected to the common wire of the amplifier, so as to reduce feedback from the microphone. When operating, sound waves pass through opening 14 of panel 11, while sound at the rear of the speaker 19 is directed into the chamber 23, it is baffled at the rear of speaker 19, by baffle 26, which, by its inherent shape, and in cooperation with the annular chamber 23, delays its exit from the spaces 18 of panel 11.

It shall also be noted, that speaker 19 is preferably an eight inch co-axial type, and when employing two or more of the enclosures 10, in an auditorium, they should be equally spaced apart, so as to create a giant column, which will fill the entire auditorium with simultaneous instant sound.

It shall further be noted, that the speakers 19, in the abovedescribed instance, must be phased the same, to respond simultaneously alike.

While various changes may be made in the detail construction, it is understood that such changes will be within the spirit and scope of the present invention, as is defined by the appended claims.

I claim:

1. A speaker enclosure, comprising, in combination, a square-shaped, plywood panel, a circular central opening through said panel, a circular row of secondary openings through said panel being located concentrically around an outer side of said central opening, a concentric, circular ring thus being formed between said central opening and said secondary openings, and a spoke portion formed between each said secondary opening, and extending radially outwardly from said ring; a circular, hollow, fiberglass dome mounted on a rear side of said panel, and forming a closed chamber on a rear side of said central and secondary openings; a central portion of said dome being inwardly concaved a part distance toward said panel, a speaker inside said chamber having a front side mounted on said ring, and a rear side thereof engaging said concaved central portion of said dome, a frusto-conical baffle around a side of said speaker being mounted at one end on said rear side of said panel, and extending divergingly rearwardly inside said chamber, and a galvanized wire screen covering an inner side of said secondary openings being bonded to a metallic coating on an inner peripheral surface of said dome.

* * * * *